US005460294A

United States Patent [19]

Williams

[11] Patent Number: 5,460,294

[45] Date of Patent: Oct. 24, 1995

[54] SINGLE DOSE PHARMACEUTICAL DISPENSER SUBASSEMBLY

[75] Inventor: David R. Williams, Temecula, Calif.

[73] Assignee: Pyxis Corporation, San Diego, Calif.

[21] Appl. No.: 241,787

[22] Filed: May 12, 1994

[51] Int. Cl.[6] ..... G07F 11/18

[52] U.S. Cl. ..... 221/2; 221/4; 221/7; 221/12; 221/79; 221/81; 221/88; 221/90; 221/124; 221/125; 221/152; 221/197; 221/224; 221/249; 221/256; 221/281; 221/287

[58] Field of Search ..... 191/12 R; 221/2, 221/4, 7, 8, 12, 13, 76, 79, 81, 83, 85, 86, 88, 89, 90, 92, 123, 124, 125, 126, 129, 152, 153, 154, 197, 224, 247, 249, 253, 255, 256, 258, 281, 282, 287, 312 B

[56] References Cited

U.S. PATENT DOCUMENTS

| | | | |
|---|---|---|---|
| 2,809,083 | 10/1957 | Goodyear | 221/76 X |
| 3,792,189 | 2/1974 | Stengel et al. | 191/12 R X |
| 3,861,562 | 1/1975 | Owen | 221/85 |
| 4,722,058 | 1/1988 | Nakayama et al. | 221/12 X |
| 4,811,764 | 3/1989 | McLaughlin | 221/4 X |
| 5,014,875 | 5/1991 | McLaughlin et al. | 221/2 |
| 5,314,243 | 5/1994 | McDonald et al. | 221/2 X |

*Primary Examiner*—William E. Terrell
*Assistant Examiner*—Dean A. Reichard
*Attorney, Agent, or Firm*—John J. Murphey

[57] ABSTRACT

A subassembly for use in a computerized medicine dispensing station is disclosed. The station has a cabinet for housing openable drawers in stacked arrangement containing dispensable pharmaceutical items. The subassembly includes a drawer having a base plate, side walls, and a front panel defining an interior compartment. The drawer can be inserted into the cabinet. The interior compartment of the drawer is divided into subcompartments, each subcompartment defined by spaced apart side walls and a curved rear wall. Each subcompartment contains a movable magazine mounted therein for racetrack-like movement therein between the spaced apart side wall and the curved rear wall. The magazine includes individual open cups for containing single dispensable pharmaceutical items therein. The front panel has an aperture which is normally closed and locked. The subassembly also includes a first device for moving the magazine upon receiving appropriate instructions, to a position in which one of the cups is located inside one of the doors, a second device for detecting the presence of an item in the cup, and unlocking and partially opening the door for further opening by a user, and a third device for closing and re-locking the door following extraction of the item from the door.

35 Claims, 8 Drawing Sheets

PRIOR ART

SINGLE DOSE PHARMACEUTICAL DISPENSER SUBASSEMBLY

BACKGROUND OF THE INVENTION

1. Field of the Invention

This invention pertains to the field of dispensing machines. More particularly, this invention pertains to computer-enhanced locked storage cabinets and to a subassembly for use therein for rapidly and accurately dispensing single doses of pharmaceutical items.

2. Description of the Prior Art

The prior art has already been introduced to the practice of dispensing pharmaceutical items, such as preloaded syringes, ampules of special medicine, and other such items from a pharmacy to a specific location in a hospital or other care facility, and ultimately to the patient. While such a practice is needed to properly treat a patient, it is fraught with high labor costs, the likelihood of inaccuracy, and the potential for abuse.

In a typical situation, the treating physician's written medication order is sent to the central pharmacy. The pharmacy dispenses the ordered item, charges the patient for that item and notes a reduction in its inventory of remaining items for later re-ordering. The item is then physically transported to the central control area of the floor or ward where the patient is located; a copy of the medication order accompanies the item to be compared with the copy of the medication order left at the central control by the physician. The item is then taken by a nurse to the patient's room for treatment of the patient. A notation is then made in the nurse's log showing that the item was, indeed, dispensed and used on the patient.

The sheer number of persons involved in this procedure renders significance to the cost ultimately borne by the patient or health care insurer for that particular hospital visit. In addition, the amount of paperwork is a serious burden to those who must fill it out and to facilities in which to store the documents. Further, numerous individuals are involved with receiving and filing the paperwork, and dispensing the item. And, finally, there is the ever-present problem of the possibility that certain pharmaceutical items, such as drugs, and the like, will fall into the hands of persons whose proclivities are to convert these items to their own use or for sale to others. All of this manual handling of pharmaceutical items and their accompanying paperwork have given rise to the burgeoning cost of health care.

Significant inroads have been made with the use of computers coupled with locked storage devices. For instance, U.S. Pat. No. 5,014,875 discloses a medication dispenser station, for controlled access storage of medications and other pharmaceuticals, comprising a housing with a plurality of normally locked drawers which have been preloaded with select pharmaceuticals items. A control unit on the housing is programmed to unlock the drawers one at a time to permit access to the contents thereof, with the access being contingent upon keyboard entry of a predetermined access code and other selected information, sufficient to generate an access record. In its preferred form, each drawer includes multiple compartments containing multiple pharmaceutical items in a presorted array. One or more of the drawers includes a multi-compartment carousel tray which rotates in response to appropriate data entry via the keyboard to align and lock a designated compartment for access through an access opening in an overlying cover plate, thereby restricting access to a single compartment of the rotatable tray.

The access code and selected information generates a patient record, adjusts the pharmacy's inventory, and debits the patient's billing records simultaneously and without the need of human intervention. Situating a dispenser station on each floor of the hospital or other care facility eliminates courier costs and reduces the time delay between medication ordering to actual use or treatment. Retaining the pharmaceutical items in locked storage reduces the likelihood of theft. And, requiring access coding of each nurse or other person who handles the pharmaceuticals establishes an accountability that further reduces the possibility of errors.

A problem has arisen in that the multiple compartments containing multiple pharmaceutical items in a presorted array do not provide the security desired to control certain items. For instance, multiple pre-loaded syringes of certain medications, such as genetic material, and certain drugs, such as pain killers, require even more control than is now provided. These items require individual control and heightened security. This is not possible when they are stocked in groups. Even if each item was individually stocked in existing dispensing stations, there is not enough compartments in a single carousel tray to store a significant amount of the items. What is needed is a drawer, interchangeable with one of the carousel trays in the medication dispenser station previously described, that can store and dispense a high plurality of pharmaceuticals such as pre-loaded syringes and the like so that the computerization and control benefits of the dispenser station are retained and the capacity of the station to inventory and dispense the items is greatly increased.

SUMMARY OF THE INVENTION

This invention is such a device. It comprises a drawer or subassembly that is capable of holding a large amount of pharmaceutical items, such as 40 items, in a single magazine for dispensing, one-at-a-time, from locked storage under extremely tight security. The invention can hold a plurality of individual magazines, such as six, to give the drawer the potential of inventorying 240 separate pharmaceutical items, each ready for dispensing under rigid control from extremely strong security.

The invention utilizes the same computer inputs, such as the predetermined access codes and other selected information, generally used for dispensing other items from other drawers in the dispenser station. The subassembly generally takes the place of one drawer, however, in another embodiment, a subassembly is provided that takes the place of two drawers, in vertically stacked arrangement, that holds items of greater height, such as longer pre-loaded syringes. The invention uses the same guides on which other drawers are mounted so that changing one drawer for another is a simple process of pulling one out and pushing the other one in.

A narrow door opens at the front of each individual magazine to dispense the pharmaceuticals one at a time. The invention includes control of door movement and a special design of the magazine that prevents access to the interior of the drawer so that all other items are retained interior the drawer under rigid security. A unique monitoring system is included that insures that one and only one item is dispensed at a time. This further improves the accuracy of the overall station.

Each magazine is individually removable from the drawer for maintenance or otherwise. Further, the magazines are easily loaded and unloaded from the top. A novel numbering system is incorporated to aid in quickly reviewing the status of each magazine. Finally, the drive mechanisms for each magazine is of simple, strong construction to reduce construction and maintenance costs. With this invention, the medication dispenser station, such as the one shown in U.S. Pat. No. 5,014,875, will have its capacity for holding and dispensing individual pharmaceutical items, increased well over two hundred fold to reduce health care costs even more from the savings already achieved by use of the dispenser station.

Accordingly, the main object of this invention is a subassembly for use in a medication dispenser station for holding a large plurality of small pharmaceutical items in locked storage and dispensing them, one-at-a-time, contingent upon keyboard entry of a proper predetermined access code and other selected information. Other objects of the invention include a device for holding a large plurality of different items, in separate magazines for dispensing through a plurality of doors; a device having dispensing doors formed at the front thereof which, in cooperation with the magazine holding the items, bar entry into the drawer or into other portions of the magazine so as to maintain a high degree of security therein; a device where each pharmaceutical item is stored in its own separate magazine cup for close control during the dispensing operation; a device having the ability to store and dispense a large plurality of short and tall items; a device easily insertable in a standard medication dispenser station without modification of the station; a device that dispenses one item at a time under full electro-mechanical control to prevent theft of the specific item or of other items retained in storage; a device where the magazines are easily removable for maintenance and easily reloaded with other dispensable items; and, a device that is simple and rugged in construction.

These and other objects of the invention will become more apparent when reading the description of the preferred embodiment along with the drawings that are appended hereto. The protection sought by the inventor may be gleaned from a fair reading of the claims that conclude this specification.

DESCRIPTION OF THE PREFERRED EMBODIMENT

Figure 1:
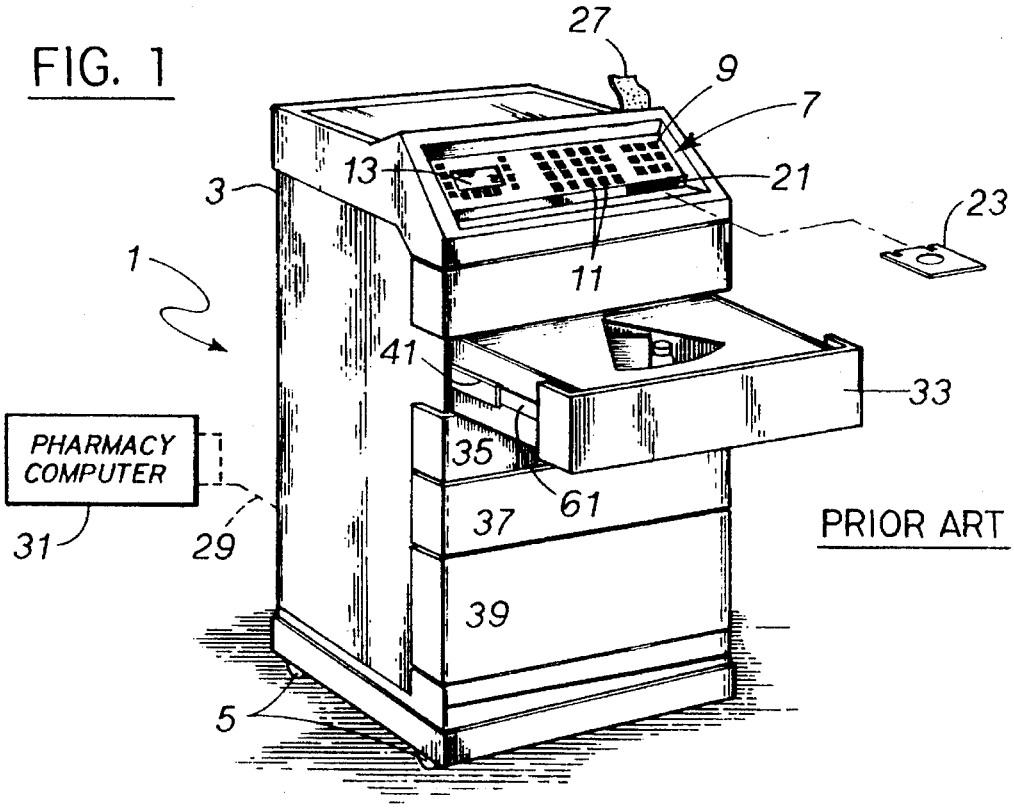
FIG. 1 is a front trimetric view illustrating a typical medication dispenser station into which the subassembly or drawer of this invention is useful.

Turning to the drawings where like elements are identified with like numerals throughout the thirteen figures, FIG. 1 shows the typical prior art dispenser station 1 comprising a compact housing 3 which may be supported on wheels 5 for convenient portability. A control unit 7, designed for relatively quick and easy access and relatively simple keyboard entry of appropriate predetermined authorization access codes and other information, is mounted generally within the upper extent of housing 3 and includes a keyboard 9. Said keyboard includes an array of keys 11 or similar entry devices for entering information, in conjunction with a display which utilizes liquid crystal elements or the like in programmed interaction with entered information.

Figure 2:
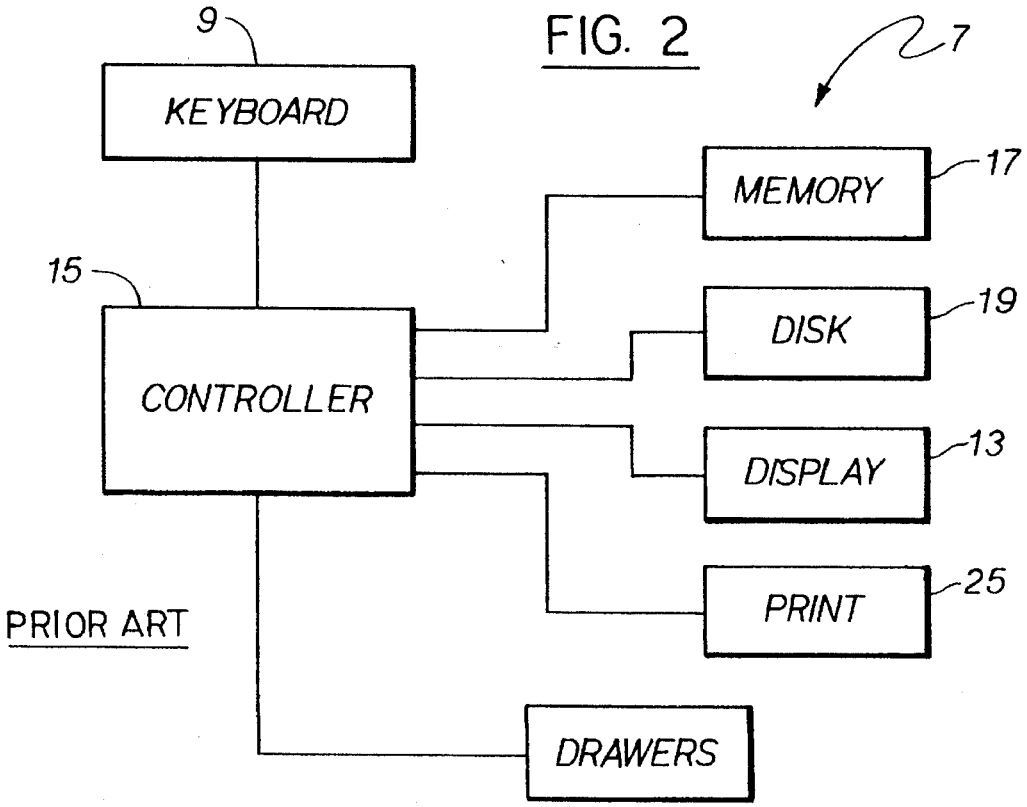
PRIOR ART FIG. 2
FIG. 2 is a schematic diagram depicting elements of a station control unit.

FIG. 2 depicts a controller unit in schematic form with keyboard 9 for information to a controller 15. Controller 15 is programmed to regulate access to the station drawers, and to generate an access record which is stored in an internal memory 17, or recorded via a disk drive 19 having an exposed disk port 21 to receive a conventional disk 23. Alternately, the access record can be displayed on the station display 13 and/or otherwise printed by means of an integral printer unit 25 for appropriate printout onto paper tape 27 (see also FIG. 1).

The control unit 7 is preprogrammed with appropriate information regarding the medication types associated with a group of patients assigned to dispenser station 1. In a preferred form, this preprogramming occurs by virtue of a data link 29 which interconnects station 1 to a main computer such as a pharmacy computer 31 (see FIG. 1) of the type used commonly in a centralized hospital pharmacy to track patient requirements for medication and other pharmaceutical items. In this regard, pharmacy computer 31 desirably includes appropriate software for programming and updating a group of dispenser stations located at centralized sites throughout a hospital facility thereby permitting regular updating of each dispenser station according to the most current patient information.

As shown in FIG. 1, dispenser station 1 includes a stack of four drawers labelled 33, 35, 37 and 39. Upper drawer 33 has a generally conventional drawer geometry and is mounted on slides 41 for opening movement with respect to station housing 3.

Figure 3:
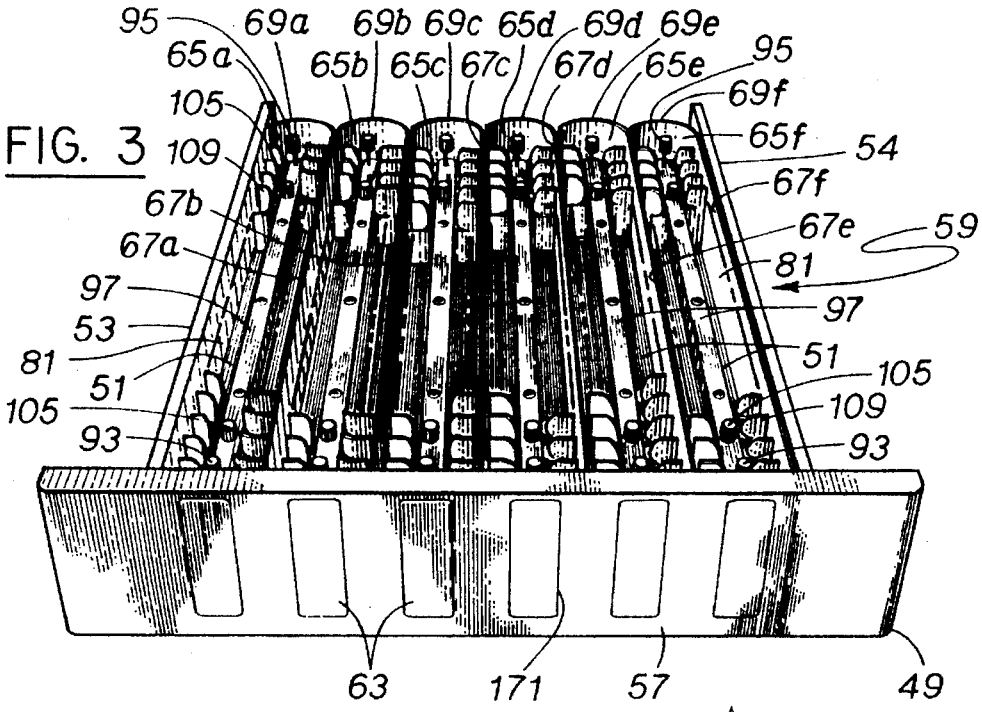
FIG. 3 is a front elevational view of the preferred embodiment of the invention showing the individual magazines positioned behind each dispensing door.
Figure 4:
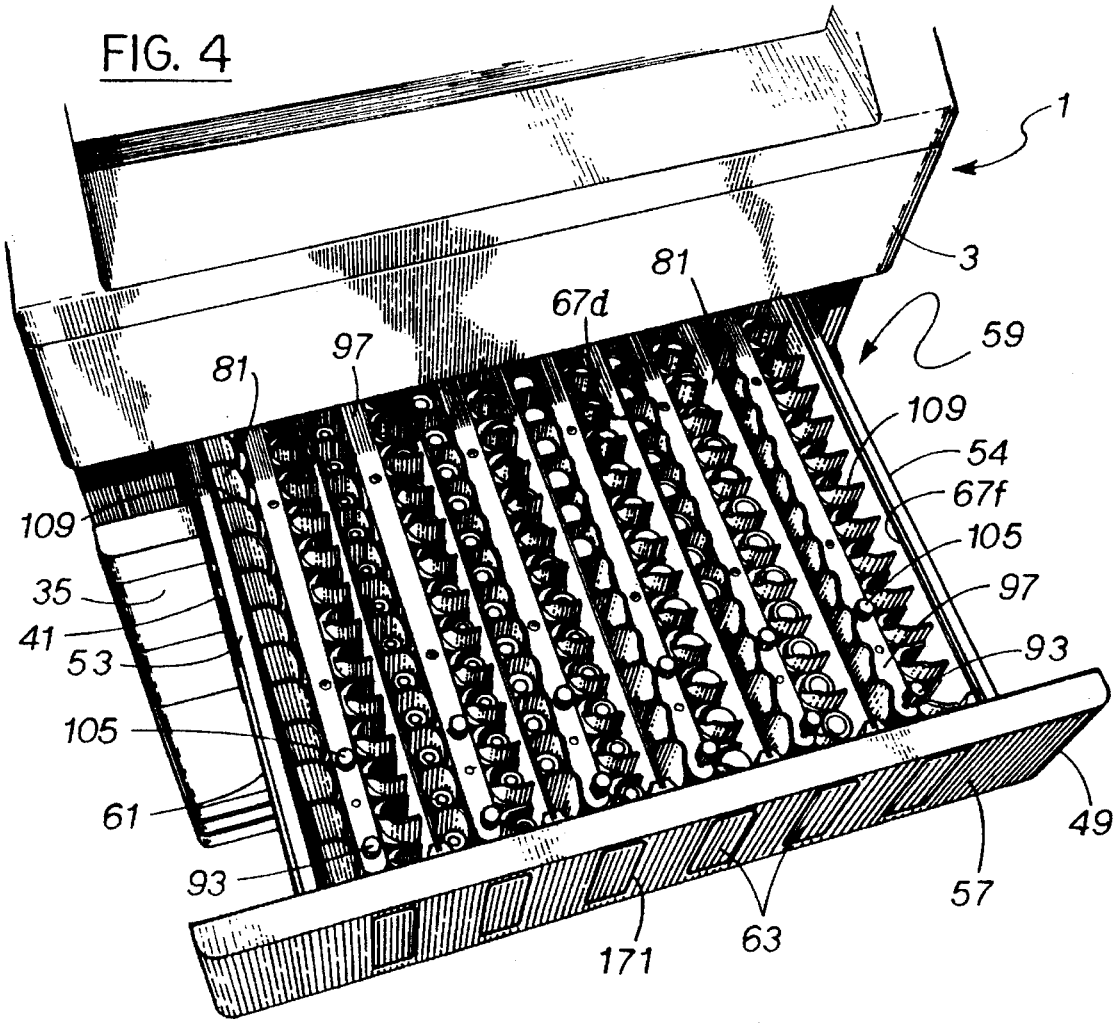
FIG. 4 is a close-up view of the magazines showing the individual cups in each.
Figure 5:
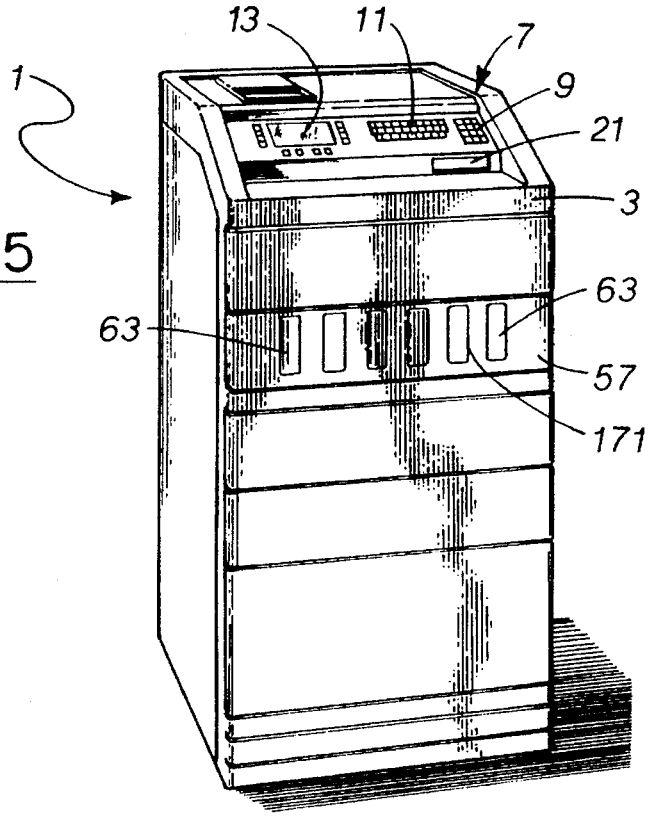
FIG. 5 is a front elevational view of the preferred embodiment inserted and closed in locked storage in the medication dispenser station shown in FIG. 1.

As shown in FIGS. 3, 4 and 5, this invention is a subassembly 49 generally comprising a flat base plate 51, a pair of mutually spaced-apart side walls 53, 54 and a rear wall 55, extending upward therefrom, and a front panel 57 all defining an interior drawer compartment 59 with the exterior being of a size and shape of a drawer for insertion into housing 3 in place of one of drawers 33–39. A pair of elongated slides 61 are attached to the outer surfaces of side walls 53 and 54 for receipt in housing slides 41 that were used to support the other drawer. Elongated slides 61 can include wheel members and reels. Accordingly, subassembly 49 fits snugly into housing 3, as with the other drawers, and is indistinguishable therefrom except for a series of openable doors 63 mounted along front panel 57 as shown in FIGS. 3, 4, 5 and 6.

As shown in FIGS. 3 and 4, compartment 59 is divided into a plurality of subcompartments **65*a* through 65*f* (preferably six in all), each subcompartment defined by a pair of spaced-apart side walls 67*a–f* and subassembly side walls 53 and 54. Side walls 67*a*–67*f* extend from inside front panel 57 rearward substantially the entire depth of interior compartment 59 to terminate at respective curved rear end walls 69*a–f* that are positioned inward from the rear end 71 of subassembly 49. A lateral space 73 is located between rear end walls 69*a–f* and subassembly rear end 71**, which will hereinafter be described in more detail.

Figure 7:
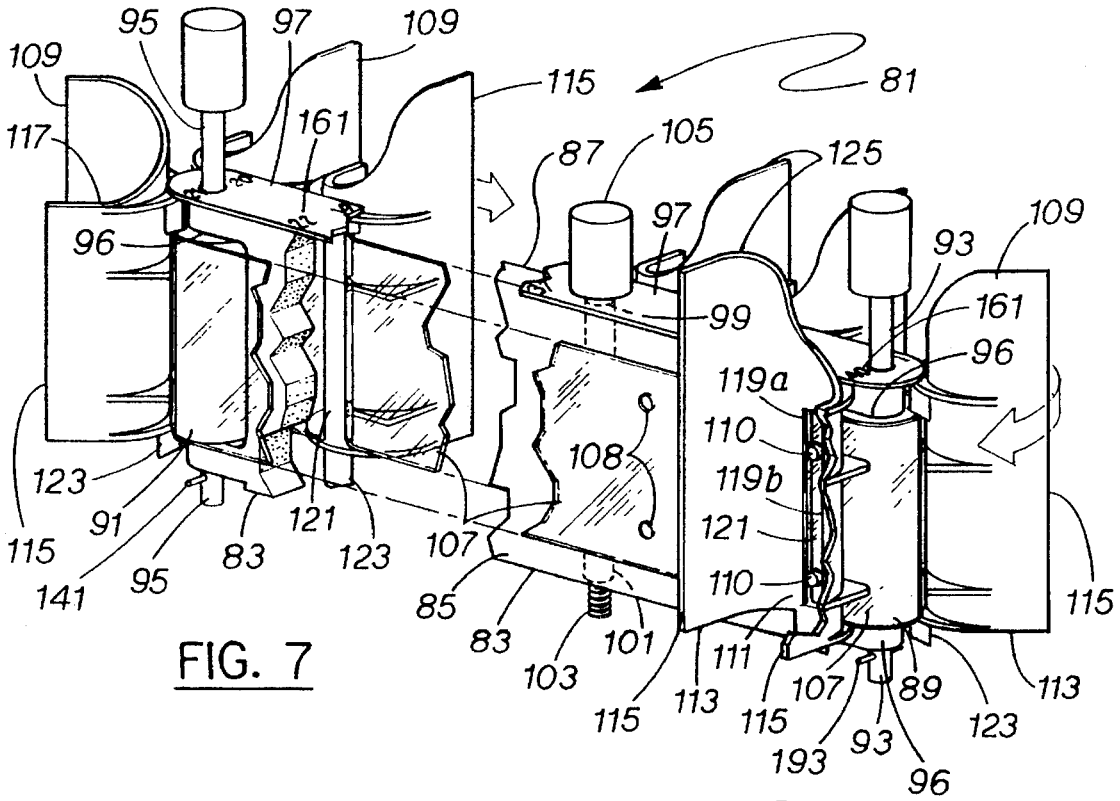
FIG. 7 is a condensed trimetric sectioned view of a typical magazine.

As shown in FIGS. 3 and 4, separate magazines 81 are mounted upright in subcompartments **65*a–f*. Each magazine 81, as shown in FIG. 7, is comprised of a thick center wall 83, having parallel outwardly facing wall surfaces 85 and 87, extending substantially the full length of a subcompartment 65, terminated at each end by a pair of narrow diameter spools 89 and 91 that are held in axial alignment with the plane of wall 83 by a pair of pins 93 and 95 that span an inset or notch 96 formed at each end of wall 83. A plate 97 covers the top marginal edge of wall 83 and has formed therethrough at least one, but preferably two or more, spaced-apart apertures 99 that are aligned with vertical bores 101 formed through wall 83 for receipt of hold down pins 103 that are inserted in said bores and threadably received in base plate 51 to mount wall 83 upright in subcompartment 65 on base plate 51, centrally between subcompartment side walls 67. A collar or knob 105 is attached to the upper end of hold down pin 103 for ease in twisting pin 103 into threadable receipt in base plate 51 to mount and dismount center wall 83**.

An endless belt 107 is fitted over center wall 83 and spools 89 and 91 and is of a length sufficient to hold itself against center wall surfaces 85 and 87 and around spools 89 and 91 and is of a height to be contained between the top and bottom marginal edges of wall 83. Attached to belt 107 is a plurality of open magazine cups 109 that each comprise an outwardly facing, upright U-shaped wall 111 attached along its center line to belt 107 and is defined by a bottom edge 113, a pair of mutually spaced-apart vertical side edges 115 and a top edge 117. A pair of spaced-apart slots **119*a* and 119*b* are formed centrally and upwardly along cup wall 111 along a strip 121 of cup wall 111 that is set back slightly to allow belt 107 to pass therethrough and attach itself thereto. A pair of spaced-apart apertures 108, formed in belt 107 at each juncture with a cup 109, receives a short post or protrusion 110, formed on cup wall 111** to hold said cups in proper alignment.

A tab 123 extends downward below strip 121 to bottom against and ride upon base plate 51 for the purpose of setting cup wall bottom edge 113 upward off base plate 51. Cup wall top edge 117 rises upward above center wall 83 along one side to form an upstanding tab 125. Preferably cups 109 are mounted next to each other so that their respective cup walls are adjacent or in slight contact while they move in racetrack fashion about center wall 83. Strip 121 extends rearward of cup 109 to effectively space belt 107 from wall surfaces 85 and 87. By this means, the friction between belt 107 and center wall surfaces 85 and 87, as well as the friction between cups 109 and base plate 51 are effectively reduced.

Figure 6:
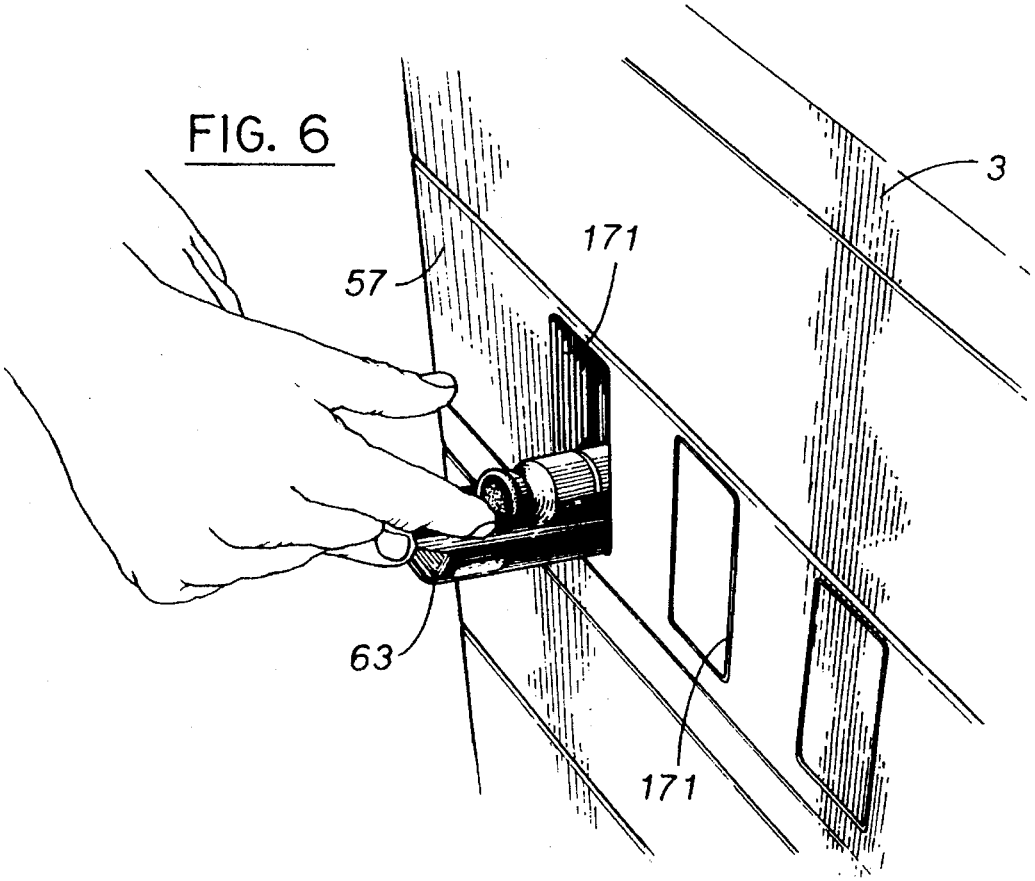
FIG. 6 is a close-up view of one of the dispensing doors pivoted into the dispensing position and dispensing a vial of pharmaceutical material to an operator.

When in position in a subcompartment 65, magazine 81 retains a plurality of pharmaceutical items, such as small vials of the type shown in FIG. 6, in separate cups and moves them in race track fashion. The curved rear walls 69 in each subcompartment assure that the items remain in their respective cups as they change direction from rearward movement, along one side of center wall 83, to forward movement along the opposite side of center wall 83. In the preferred embodiment, cup wall side edges are spaced close to the respective subcompartment side walls 67, such as within ⅛ to ¼ of an inch. This spacing prevents scraping of the cup side edges yet is close enough to prevent a vial or other pharmaceutical item from escaping the cup during movement of belt 107.

Figure 8:
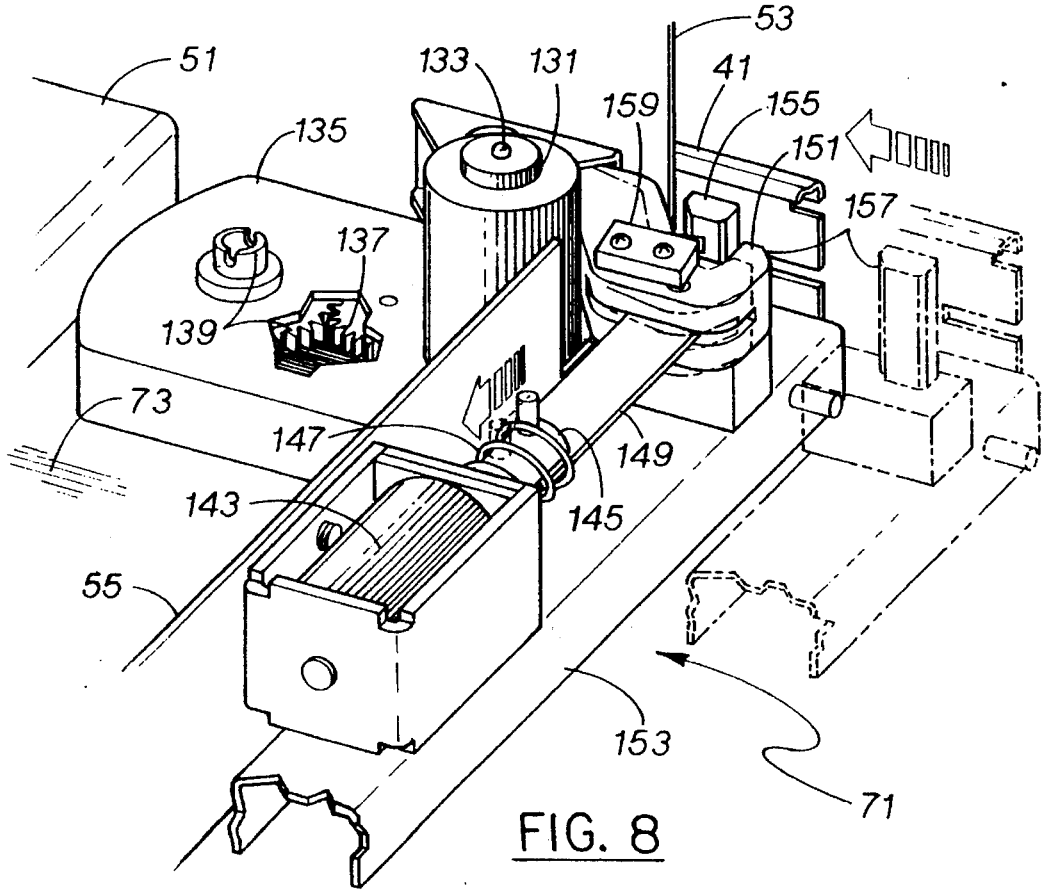
FIG. 8 is a trimetric rear view, partly in section, of a portion of the subassembly of this invention showing the drive mechanism for a typical magazine as well as the locking/unlocking mechanism for the drawer.
Figures 9A, 9B, 9C, 9D:
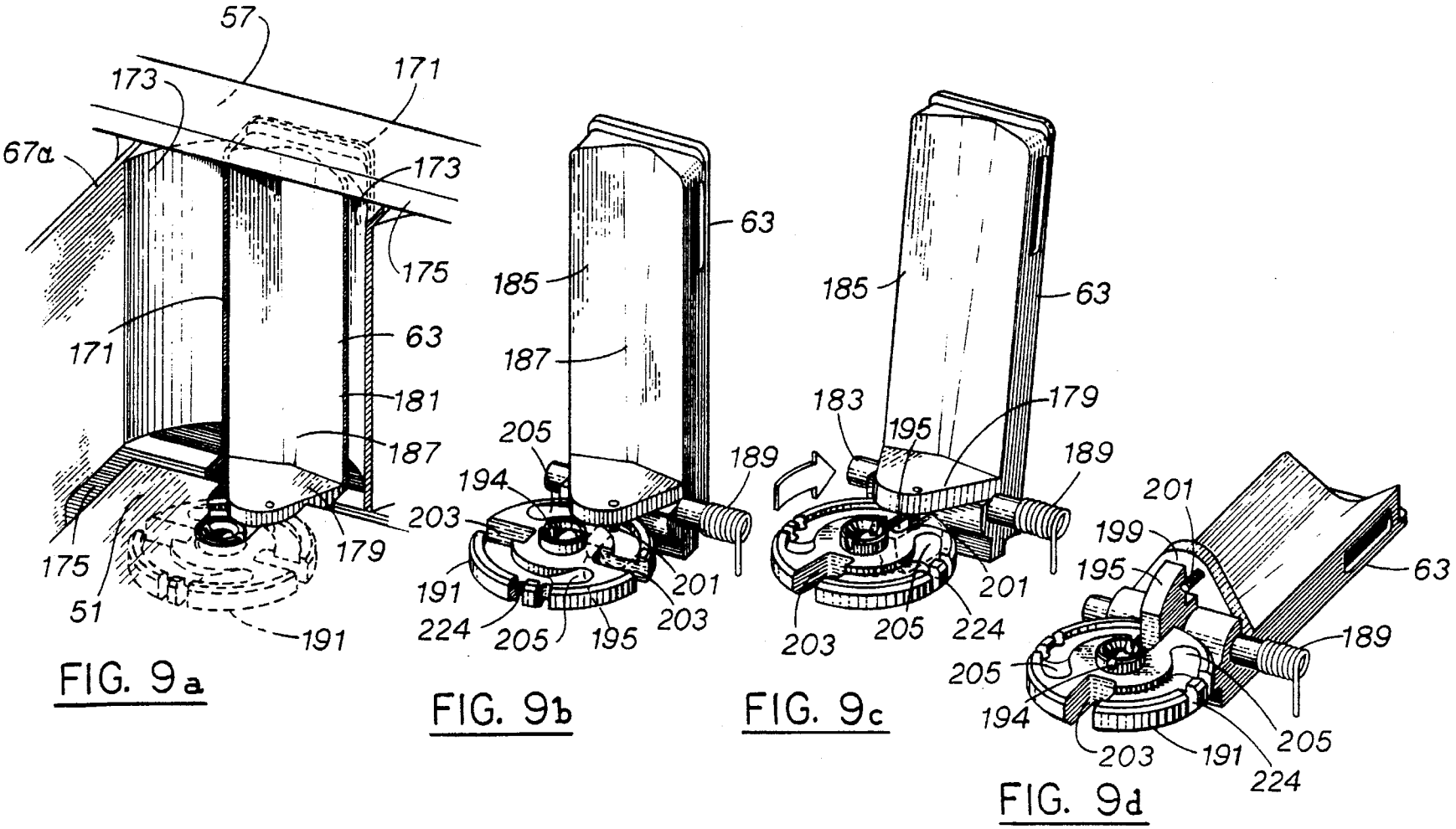
FIGS. 9*a*–9*b*–9*c*–9*d* are sequential trimetric views, partly in phantom, of the mechanism, located at the front of the drawer, for controlling the positioning of the magazine cup and opening the door to dispense the item.

As shown in FIG. 8, a separate driver, such as a direct current drive motor 131 is provided for each magazine and is preferably mounted in lateral space 73 to the rear of its respective center wall 83. Drive motor 131 has its output drive shaft 133 extending downward below base plate 51. A flat transmission 135 is located below base plate 51 and comprises a plurality of intermeshed gear wheels 137 that are driven by shaft 133. A driven output gear 139 is located below rear spool pin 95 for driving rear spool 91 through a cross-pin 141 received therein attached to the lower end of pin 95. Activation of motor 131 causes it to turn rear spool 91 through transmission 135 and move belt 107 and its attached cups 109 under close control in the race track fashion previously described.

As shown in FIG. 8, an electric solenoid 143 is mounted on subassembly rear wall 55 and has a solenoid shaft 145 reciprocally mounted therein, biased into extended position by a spring 147, and attached to an arm 149 extending outward to a latch 151 that is pivotally mounted to subassembly side wall 53. A cross-arm 153 is mounted in housing 3, at the rear of the drawer cavity and has a locking bar 155 extending upward therefrom near where latch 151 is positioned when subassembly 49 is fully inserted in dispenser station 1. A pair of mutually beveled surfaces 157 are formed respectively on latch 151 and locking bar 155 to engage and allow latch 151 to slide over bar 155 during drawer closing so that it will snap over bar 155 in locking engagement therewith at full drawer closing. When subassembly 49 is to be opened, solenoid 143 is energized to retract shaft 145 against the bias of spring 147 and move latch 151 out of locking engagement with locking bar 155. A micro-switch 159 is operably mounted on latch 151 and connected to control unit 7 to indicate when the subassembly is unlocked so that computer instructions are not lost when the particular subassembly is opened and temporarily out of commission for loading or repair, etc.

As shown in FIGS. **9*a*, a taller-than-wide aperture 171 is formed in front panel 57 opposite magazine front spool 89 for retrieval therethrough of the pharmaceutical item temporarily stored in a particular magazine cup 109. A pair of beveled strips 173 are mounted in mutually spaced-apart arrangement on the inner surface 175 of front panel 57, one on each side of aperture 171, so as to aid in retaining the pharmaceutical items in cups 109 as they approach aperture 171** from either direction.

Door 63 is in the form of an L-shaped structure, comprising a flat outer surface, and a short inwardly extending base 179, joined at one end to the base of an upwardly extending door wall 181, is pivotally mounted, with a cross-pin 183 passing transversely through said door at the aforesaid juncture, in aperture 171 such that base 179 extends inward under where a cup 109 would be located, if positioned adjacent said aperture, and said upward wall is flush with the outer surface of front panel 57. The inner surface 185 of door wall portion 181 has a centralized V-shaped cross-section 187 formed therein to bias the pharmaceutical item in the center of door 63 when the item is position for removal. A spring 189 is provided to bias door 63 fully closed against front panel 57.

As shown in FIGS. 9*a*–9*b*–9*c*–9*d*, a control disk 191 is located below base plate 51 and engages front spool pin 93 through a cross-pin 193 received in a slot 194 formed therein, to be rotated by pin 93 in a plane parallel to base plate 51 as magazine 81 moves along its race track course. A door tang 195 extends downward from door base 179, inside front panel 57, and has a horizontal slot 199 formed therein that encompasses a radial portion of control disk 191 when door 63 is closed. A small protrusion, such as adjustable set screw 201, is threadably received in a small offset bore formed in door base 179 and bears against the top surface of control disk 191, under bias pressure from spring 189.

As shown in FIGS. 9*a*–9*b*–9*c*–9*d*, control disk 191 is driven by magazine 81. It is arranged to turn 180° each time a magazine cup is moved into position behind aperture 171. Two radial slots 203 are formed in control disk 191 on opposite sides thereof and are designed to allow door tang 195 to pass or slip therethrough when door 63 is rotated fully outward to extract the pharmaceutical item. Upon the appropriate keyboard entry of an access code and other necessary information, drive motor 131 is energized to move magazine 81 in its race track pattern to bring a pharmaceutical item, contained in magazine cup 109, into position behind door aperture 171. As this happens, disk 191 is rotated to bring a slot 203 into registration with door tang 195. As disk 191 rotates slot 203 into registration, a ramp 205, formed on the surface of disk 191, is brought into contact with offset protrusion 201, pushing door base 179 upward and pivoting or tipping door 63 partially outward from the plane of front panel 57. As door base 179 is pivoted upward under magazine cup 109, the pharmaceutical item in cup 109 is urged forward into V-shaped, cross-section 187 inside door wall 181.

With the door slightly open, the user is now put on notice that the pharmaceutical item nestled inside is ready for extraction. As shown in FIG. 6, the user merely tips out door 63, against the spring bias, and extracts the item nestled inside. Tab 125, formed in cup wall 111 prevents the user from reaching past one side of cup 109 to get to other pharmaceutical units in other downstream cups, while the same tab on the adjacent cup prevents reaching past the other side of cup 109 to get to other pharmaceutical items in other upstream cups. When door 63 is allowed to swing back into partially open position under spring bias, magazine belt 107 is driven by motor 131 a few millimeters further to turn disk 191 a few angular degrees to cause ramp 205 to pass out of contact with protrusion 201 to allow door 63 to fully close and move disk slot 203 out of registration with door wall 195 so as to prevent further opening of door 63 by interposing disk 191 into slot 199.

The very small diameter of spools 89 and 91 insure that belt 107 reverses its direction very quickly at the end of center wall 83. As a cup 109 approaches one of the spools, its angular position vis-a-vis wall 83 begins to change rapidly. When belt 107 and its cup 109 contact spool 89, a few millimeters of travel result in the cup being swung through a large angular arc. Close control of belt movement (position) is accomplished by close control of drive motor 131.

Figure 10A:
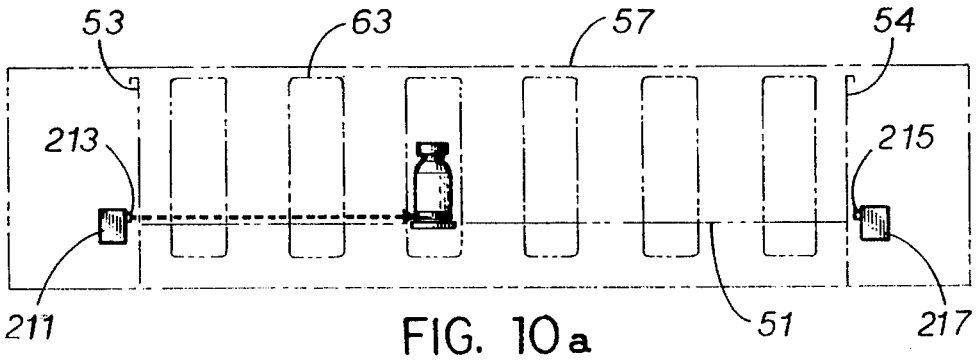
FIGS. 10*a* and 10*b* are front elevational views of the subassembly, in phantom outline for clarity, that indicate the path of radiation from a radiation source that plays an important part in dispensing items from the dispenser station.
Figure 10B:
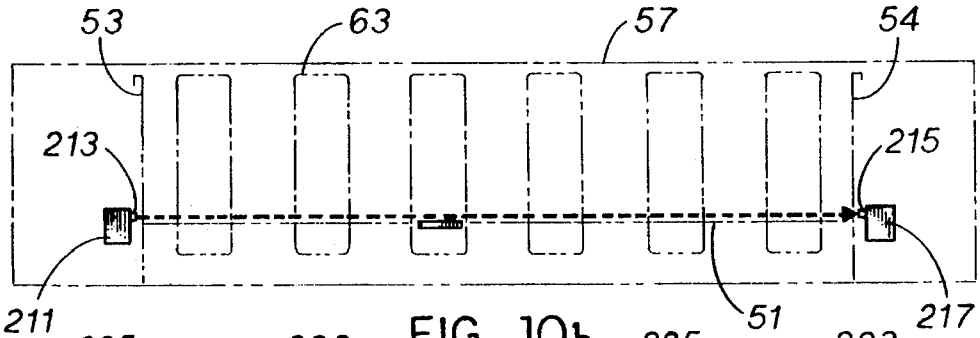

As shown in FIGS. 10*a*–10*b*, a radiation source 211 is mounted outboard of subassembly side wall 53 and arranged to have its radiation directed through an aperture 213 and across the width of drawer compartment 59 at the front thereof and specifically through the gap created between the upper surface of base plate 51, the upper surface of door base 179, and magazine cup bottom edge 113 when the cup is in position behind door 63. On the opposite side wall 54 is one or more apertures 215 behind which are mounted radiation receivers 217. In the operation of this invention, only one item-filled cup is presented for retrieval behind one door at anytime during the use of subassembly 49. This means that only one item-filled cup will be present at any one time behind any one door. Accordingly, the beam from radiation source 211 will be intercepted by the presence of an item in a cup positioned behind a door and further intercepted by tang 195 moving into position as door 63 is opened, thus notifying control unit 7 to lock in the dispensing cycle and rotate no more items behind any door until the particular item is withdrawn from the magazine. Should the beam not be intercepted (no item behind any door), the control unit will continue with the dispensing cycle and will notify the user accordingly.

Figure 11A:
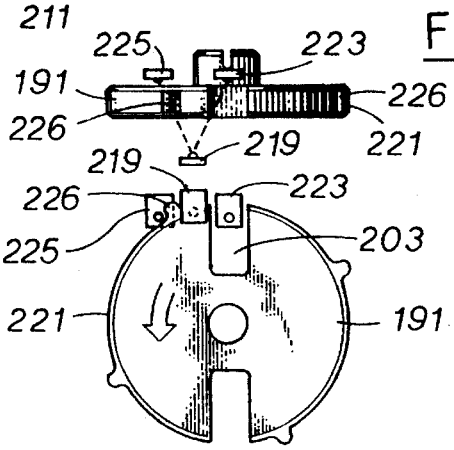
FIGS. 11*a*–11*b*–11*c*–11*d* are sequential trimetric views, partly in phantom, of an alternate embodiment of the mechanism, located at the front of the drawer, for controlling the positioning of the magazine cup and opening the door to dispense the item.
Figure 11B:
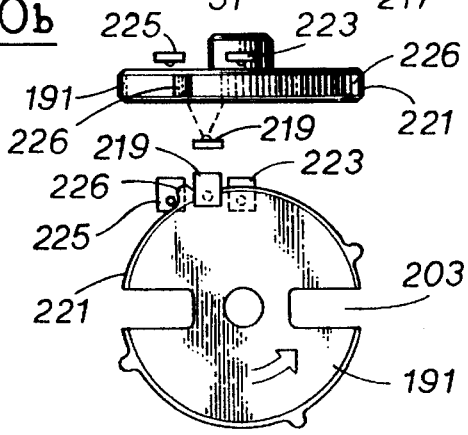

As shown in FIGS. 11*a* and 11*b*, another radiation source 219 is located on one side of control disk 191, near its circumferential edge 221, and preferably below said disk, and arranged to radiate two beams of energy upward, to two spaced-apart radiation receivers 223 and 225 located on the other side of control disk 191. Receiver 223 is located inboard of disk circumferential edge 221 so that it will only receive radiated energy when either of disk slots 203 are aligned therewith. Receiver 225 is located slightly outboard from disk circumferential edge 221.

Receiver 223 first notices the beginning of slot 203 as magazine belt 107 brings an item-containing cup toward position behind door 63. At this first hint of radiation, drive motor 131 is directed to turn very accurately a few more degrees to center slot 203 exactly over where door tang 195 will eventually pass during the vending operation. After the pharmaceutical item is removed from the cup and door 63 springs closed, the radiation beam passing under cup bottom wall edge 113 will now be unobstructed and will be received in receivers 217. This completed beam will cause drive motor 131 to drive belt 107 a short distance to turn control disk 191 approximately 90°. A small protruding tab 226, extending outward from disk circumferential edge 221 will pass over the receiving port of radiation receiver 225 to interrupt the radiation beam. At this point drive motor is de-energized to stop the motion of magazine 81 and, in essence, lock up the system. Access through door 63 is denied because of the presence of disk 191 in door tang slot 199. Door 63 is made flush with the surface of front panel 57 and closely spaced about its peripheral edge to the edges of aperture 171 to form a tight fit therebetween to discourage the use of a pry bar or other burglary tool.

Figure 11C:
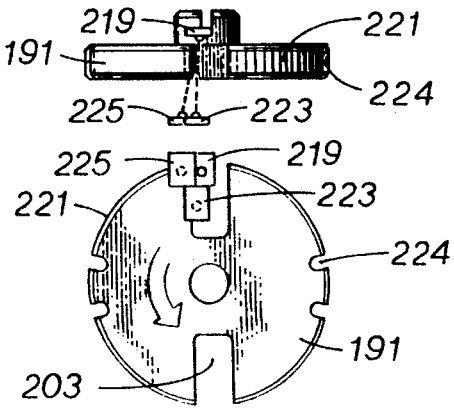
Figure 11D:
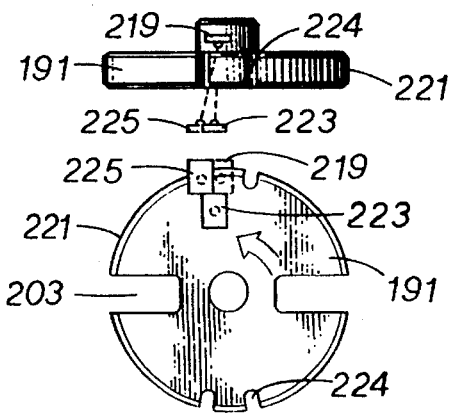

FIGS. 11*c*–11*d* show another embodiment of the invention where slots 224 take the place of tabs 226 in the same type of operation. Here, said slots are inwardly directed into disk 191 and are placed close together. Radiation source 219 and receiver 225 are set slightly inboard of the circumferential edge of disk 191. The radiation beam passes through one slot 224 and causes motor 131 to move magazine belt 107 and, hence, turn disk 191 so that part of it passes into tang slot 199 to lock door 63 in closed position. When disk 191 turns so that the second slot 224 aligns between radiation source 219 and receiver 225, motor 131 is commanded to stop and await further dispensing instruction.

For loading and, possibly unloading, a particular magazine, a computer control routine is initiated and solenoid 143 is energized to disengage latch 151 from locking bar 155 and allow the subassembly or drawer to be pulled open. To facilitate inventorying the remaining pharmaceutical items, prior to reloading, a novel inventory system is used. Progressive integers 161 (see FIG. 7), from 1 to the maximum number of magazine cups, such as 40, are placed along the sides of center wall cover plate 97, preferably cup number "1" being at the first position before dispensing. Control unit 7 maintains a running inventory of each magazine, debiting one pharmaceutical item from the inventory each time one item is dispensed. Upon opening the drawer (subassembly), the operator merely looks to observe the lowest integer next to the last filled magazine cup. This will indicate how many items remain in the magazine and may be cross-checked with the electronic inventory maintained in memory 17.

Figure 12A:
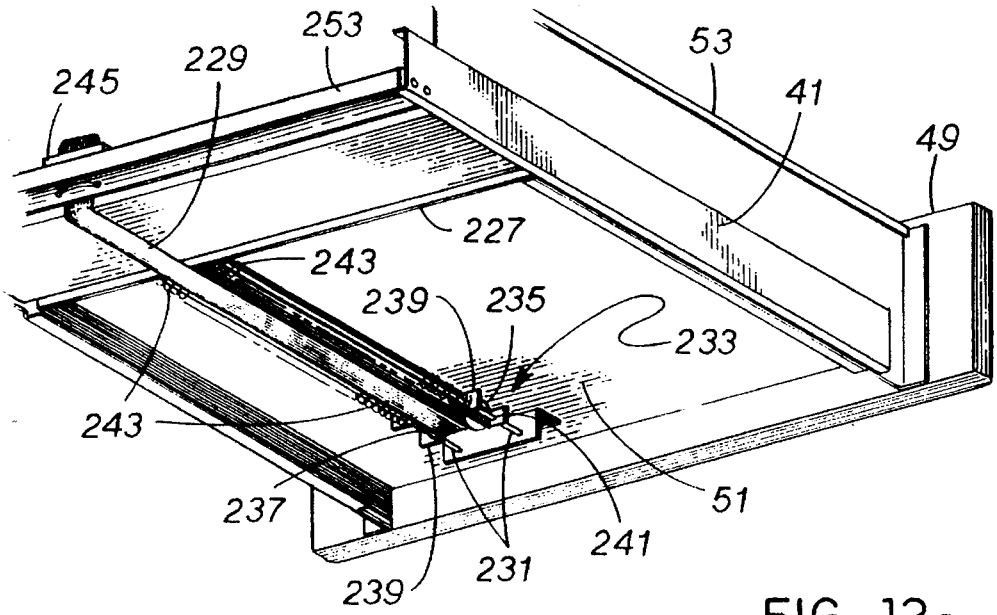
FIGS. 12*a* and 12*b* are trimetric views of the underside of the subassembly showing the novel mechanism used to prevent tangling of a flat data-transfer cable strung therebelow; and, FIG. 13 is a trimetric view of another embodiment of the invention for storing tall syringes therein, that takes up the room of two drawers in vertical stacked arrangement.
Figure 12B:
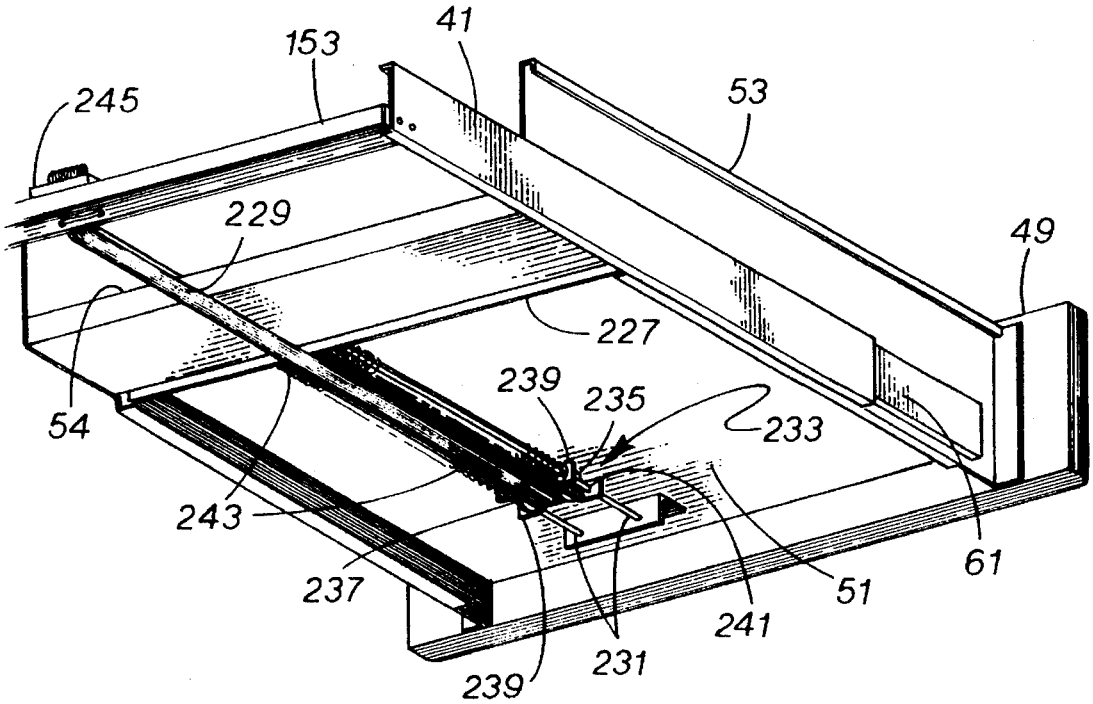

As shown in FIGS. 12*a*–12*b* a circuit board 227 is mounted on subassembly 49 for connection to control unit 7 through a flat, computer data transfer tape cable 229. This presents a significant problem during opening and closing of subassembly 49 in dispenser station 1 as the cable may become bunched up and snared in the subassembly and damaged. A novel mechanism has been developed for tensioning the tape during cycling of the drawer from open to close and vice-versa, and comprises a pair of elongated rods 231 mounted in parallel, spaced-apart arrangement under base plate 51, but above the next adjacent drawer below, and arranged to pass from near the front of subassembly 49 to the rear thereof or axially between the separate ends of said cable. A trolley 233, comprising a rotatably mounted spool 235 pivotally mounted on a cross-pin 237 is provided, the ends of which are captured centrally in a pair of mutually spaced-apart C-straps 239 having aligned apertures 241 passing therethrough and being slidingly received on said rods 231 so as to allow spool 235 to rotate and trolley 233 to move along said rods from front-to-rear and vice versa. A pair of coil springs 243 are slipped over rods 231, between the rear attachment thereof and trolley 233 to bias the trolley forward toward front panel 57. Flat cable 229 is connected to the rear portion of subassembly 49 and is directed forward, underneath base plate 51, passed or threaded over spool 235 and then rearward to terminate at a plug 245 mounted on cross-arm 153. The bias pressure of springs 243 urges spool 235 forward providing constant bias pressure to flat cable 229 and hold it in parallel arrangement under base plate 51. As subassembly 49 is pulled out from housing, the slack in cable 229 is taken up by trolley spool 235 as it moves, under spring pressure, along rods 231.

Figure 13:
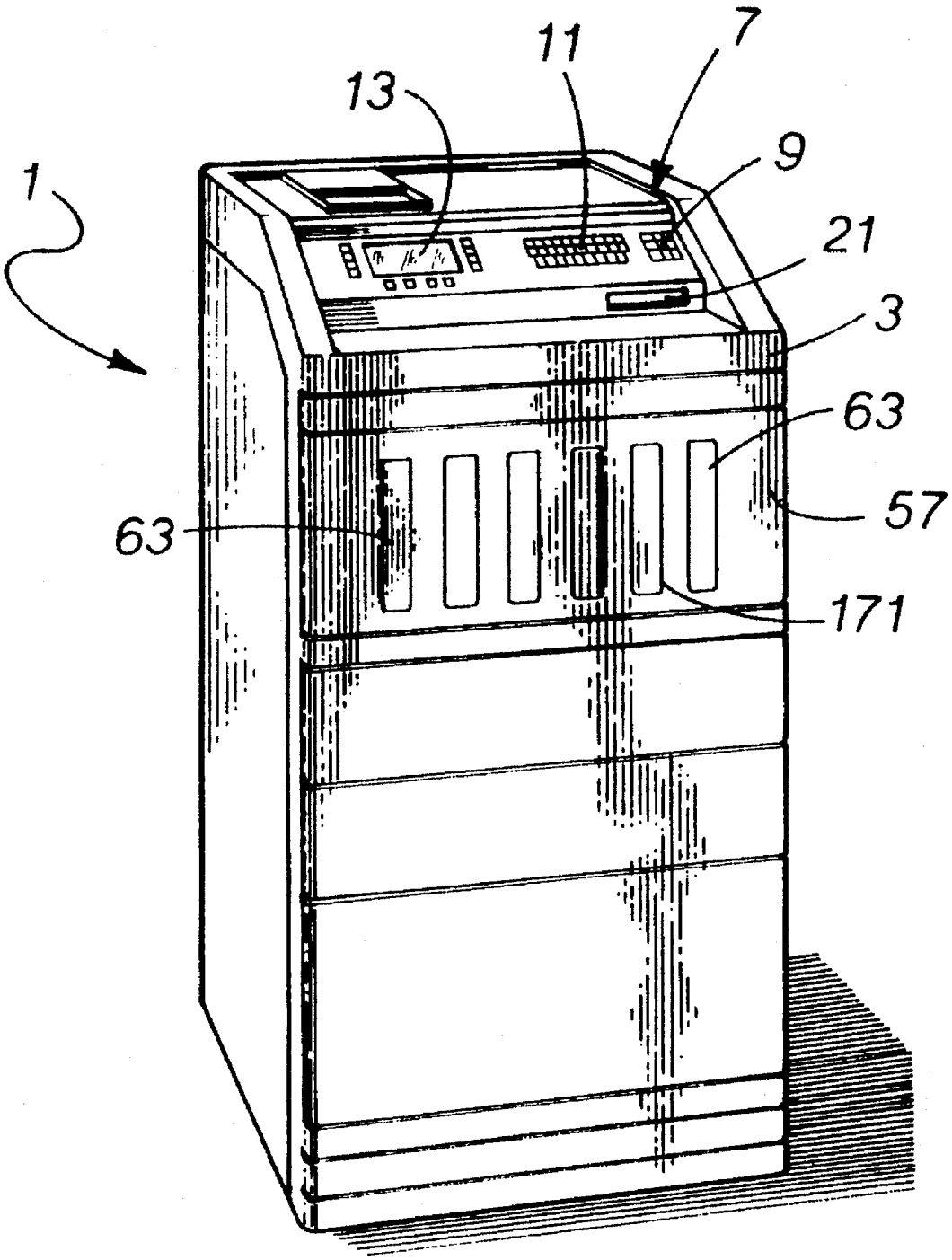

In a separate embodiment shown in FIG. 13, this invention may be employed to store and dispense taller items such as long pre-loaded syringes. This embodiment requires front panel 57 to be as tall as two drawers in adjacent, vertically-stacked arrangement. Magazine 81 need not be any taller as it is tall enough, with one drawer height, to support taller items in upright position in cups 109, however, the inside (not the outside) dimensions of the cups are preferably reduced to reduce listing or leaning of the items in the cups and retain them in an upright posture. Apertures 171 and doors 63 need to be made taller to allow passage therethrough of the taller items.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the way to achieve substantially the same result are within the scope of this invention.

What is claimed is:

1. A subassembly for use in a computerized medicine dispensing station, said station of the type having a cabinet that houses a plurality of openable drawers in stacked arrangement containing dispensable pharmaceutical items in locked storage therein for retrieval following instructions inputted into a computer integrated with the station, said subassembly comprising:

a) a drawer including a base plate, spaced-apart side walls and a front panel defining an interior compartment, said drawer of a size and shape for insertion into the cabinet;

b) said interior compartment divided into a plurality of subcompartments, each extending rearward of said front panel and defined by a pair of spaced-apart side walls and a curved rear end wall;

c) a moveable magazine mounted in a sub-compartment for racetrack-like movement therein between said side walls and said end wall, said magazine including a plurality of individual, open-sided magazine cups of a size and shape for containing single items of dispensable pharmaceuticals therein;

d) said front panel having formed therein a door aperture for each subcompartment from which the pharmaceutical items may be extracted, one at a time, from a magazine;

e) a tight-fitting, normally-closed and locked door pivotally mounted in each said door aperture;

f) first means for receiving appropriate computer instructions and moving said magazine to a position wherein a specific magazine cup is located inside one of said doors in locked position therein;

g) second means for detecting the presence of a pharmaceutical item in said cup, and unlocking and partially opening said door for further opening by a user; and, h) third means for closing and re-locking said door following extraction of the item from said door.

2. The subassembly of claim 1 further including wheel members and reels attached to said side walls of said drawer for sliding said drawer into and out of said cabinet.

3. The subassembly of claim 1 wherein said front panel is of the height of two drawers so that said drawer occupies the space of two adjacent drawers in stacked arrangement.

4. The subassembly of claim 1 including six of said subcompartments in side-by-side arrangement.

5. The subassembly of claim 1 wherein said subcompartments are of the same width and length.

6. The subassembly of claim 1 further including guide means forming a curved wall at the front end of said subcompartments.

7. The subassembly of claim 1 wherein said magazine further includes:

a) a center wall in said subcompartment intermediate said side walls of said subcompartments and extending substantially the length thereof;

b) a spool operably mounted at each end of said center wall; and, c) a drive belt passing around the outside of said center wall and said spools for movement thereabout in said racetrack-like motion;

d) wherein said cups are attached to said belt.

8. The subassembly of claim 7 wherein each of said magazine cups comprise an outwardly facing, upright U-shaped wall attached along its center line to said belt and is further defined by a bottom edge, a pair of mutually spaced-apart vertical side edges and a top edge spaced apart from said bottom edge.

9. The subassembly of claim 8 wherein said cup wall has formed therein a pair of spaced-apart slots to allow said belt to pass therethrough and attach itself thereto.

10. The subassembly of claim 9 further including a short protrusion, formed on said cup wall, received in an aperture formed in said belt to hold said cup in alignment therewith.

11. The subassembly of claim 1 further including a tab extending below said cup wall for riding against said base plate to set said cup up off said base plate during movement of said magazine.

12. The subassembly of claim 1 further including tabs formed on said cups and extending upward therefrom to prevent insertion of one's fingers or an instrument through said door into said interior compartment to prevent theft of other pharmaceutical items from other cups in said magazine.

13. The subassembly of claim 1 further including a motor operably connected to said magazine to power it in its racetrack-like movement.

14. The subassembly of claim 7 further including a motor operably connected through gear wheels to one of said spools for turning said spool and driving said belt in its racetrack-like movement.

15. The subassembly of claim 14 wherein said gear wheels are contained in a flat transmission mounted below said base plate.

16. The subassembly of claim 1 further including means for latching said drawer into fixed closed position in said cabinet.

17. The subassembly of claim 16 wherein said latching means includes:

a) a solenoid operably mounted at the rear of said drawer;

b) a shaft reciprocally mounted in said solenoid having one end extending outward therefrom;

c) a latch pivotally mounted on said drawer and arranged to latch against a locking bar mounted to the cabinet and be unlatched by said shaft when said solenoid is electrically energized; and, d) a spring for biasing said latch into locking engagement with said locking bar when said drawer is moved into closed position in the cabinet.

18. The subassembly of claim 17 further including mutually engaging beveled surfaces formed on the respective surfaces of said latch and said locking bar to allow said latch to move out of interference with said bar when said drawer is moved into closed position in the cabinet.

19. The subassembly of claim 17 further including a microswitch operably positioned on said latch to close or open to signal the position of said drawer in the cabinet.

20. The subassembly of claim 1 wherein said door aperture is taller than wide.

21. The subassembly of claim 1 further including a pair of beveled strips arranged in spaced-apart position, one on each side of the aperture inside said front panel to aid in retaining the pharmaceutical items in said cups as they approach said aperture.

22. The subassembly of claim 1 wherein said door is in the form of an L-shaped structure, including a flat outer surface and a short, inwardly extending base, joined at one end to the bottom of said door, and said door is pivotally mounted with a cross-pin passing transversely through said door at said junction.

23. The subassembly of claim 1 wherein said door is made flush with the outside surface of said front panel.

24. The subassembly of claim 1 wherein said door includes a V-shaped cross-section formed on the inner surface thereof to bias pharmaceutical items into the center of said door.

25. The subassembly of claim 1 wherein said first means includes:

a) a keyboard for inputting patient access codes, user access codes and medication information into the computer;

b) a monitor for displaying some of the inputted information;

c) a controller in communication therewith to regulate access to said drawers and to generate an access record.

26. The subassembly of claim 25 further including an internal memory to store information.

27. The subassembly of claim 1 further including a disk drive interconnected said computer from which information may be extracted to operate the station.

28. The subassembly of claim 1 further including a printer for printing an appropriate output onto paper tape.

29. The subassembly of claim 1 wherein said second means includes:

a) a first radiation source mounted outboard of said magazine and arranged to have its radiation beam directed through an aperture and across the width of said drawer inside said front panel;

b) a first radiation receiver mounted outboard of said magazine and arranged to receive said radiation beam from said source as long as there is no pharmaceutical item or other element blocking said radiation path, so that the presence of a pharmaceutical item in any cup positioned inside a door, ready for dispensing, causes an interruption of said beam; and, c) means responsive to the interruption of said radiation to prevent further dispensing of items from said drawer until the aforesaid radiation beam is again detected by said receiver.

30. The subassembly of claim 1 wherein said third means comprises:

a) a tang extending inward from said door;

b) said tang having a horizontal slot formed therein;

c) a disk rotatably mounted below said base plate, driven by said magazine, and arranged to have a radial portion thereof pass through said horizontal slot;

d) said disk having a vertical slot formed therein that, when centered in front of said door, allows said tang to pass upward therethrough when said door is pivoted outward;

e) a base extending inward from said door and including a small protrusion arranged to ride over the top surface of said disk as said disk rotates with said magazine;

f) means for biasing said door into closed position against said front panel; and, g) a ramp formed on said disk for moving into contact with said protrusion to pivot said door slightly outward, against said bias means, when a pharmaceutical item is moved into position directly behind said door, and said disk slot is centered in front of said tang, to allow the user to pivot said door fully outward and extract the pharmaceutical item, and allowing said tang to pass through said disk slot;

h) said ramp moving out of contact with said protrusion upon extraction of the item, to allow said door to close fully against said front panel.

31. The subassembly of claim 30 further including:

a) a second radiation source mounted on one side of said disk, near the circumferential edge thereof and having its radiation beam directed across said disk;

b) a second radiation receiver mounted on the other side of said disk, near the circumferential edge thereof, and arranged to receive said radiation beam from said second source; and, c) an outwardly protruding tab formed on said circumferential edge of said disk for moving into interference with said radiation beam, wherein following extraction of the pharmaceutical item from the door and re-establishment of said first radiation beam after said door is closed, said magazine is caused to move said cup out of position behind said door and simultaneously rotate said disk to move said tang-passing slot away from said tang and interpose said disk in said horizontal slot in said tang, said disk is rotated until said tab blocks said second radiation beam causing said magazine to stop until further ordered by new inputted instructions.

32. The subassembly of claim 31 further including:

a) a third radiation receiver positioned opposite said disk, inboard of said circumferential edge, spaced apart from said second radiation receiver and located near where said disk slot comes into alignment in front of said door tang;

b) said third receiver arranged to cause said motor to move said magazine a predetermined distance following the first instance of receiving radiation through said slot so that said tang passing slot is aligned accurately in front of said door tang.

33. The subassembly of claim 30 further including:

a) a second radiation source mounted on one side of said disk, near the circumferential edge thereof and having its radiation beam directed across said disk;

b) a second radiation receiver mounted on the other side of said radiation beam from said second source; and, c) first and second inwardly directed slots, in close proximity to each other form on a circumferential edge of said disk, said first slot arranged for moving into alignment with said radiation beam, wherein following extraction of the pharmaceutical item from the door and re-establishment of said first radiation beam after said door is closed, said beam causes said magazine to be driven until said cup moves out of position behind said door and simultaneously rotate said disk to move said tang-passing slot away from said tang and interpose said disk in said horizontal slot in said tang, said disk is rotated until said second slot is aligned with said receiver so that said beam makes contact therewith causing said magazine to stop until further ordered by new inputted instructions.

34. The subassembly of claim 1 further including a flat, computer data transfer tape cable of terminal length and means for tensioning said cable during cycling of said drawer from open to closed and closed to open, to prevent bunching up and possible damage to said cable, said means comprising:

a) a pair of elongated rods mounted in parallel, spaced-apart arrangement under said base plate, but above the next adjacent drawer below, and passing from near said front panel to the rear of said drawer;

b) a moveable trolley, including a spool pivotally mounted therein, slidingly received on said rods and arranged to move therealong; and, c) means for biasing said trolley toward one end of said rods to provide tension to said cable when it is passed around said spool intermediate its ends.

35. The subassembly of claim 34 wherein said bias means includes coil springs in concentric arrangement about said rods.

* * * * *